US011448000B2

(12) United States Patent
Cheng et al.

(10) Patent No.: US 11,448,000 B2
(45) Date of Patent: Sep. 20, 2022

(54) AUTOMATIC DOOR OPENING DEVICE AND REFRIGERATOR HAVING THE SAME

(71) Applicant: QINGDAO HAIER JOINT STOCK CO., LTD., Qingdao (CN)

(72) Inventors: Xueli Cheng, Qingdao (CN); Bin Fei, Qingdao (CN); Yazhou Shang, Qingdao (CN); Jinlin Liu, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 684 days.

(21) Appl. No.: 16/474,545

(22) PCT Filed: Dec. 27, 2017

(86) PCT No.: PCT/CN2017/118853
§ 371 (c)(1),
(2) Date: Jun. 27, 2019

(87) PCT Pub. No.: WO2018/121562
PCT Pub. Date: Jul. 5, 2018

(65) Prior Publication Data

US 2020/0131835 A1 Apr. 30, 2020

(30) Foreign Application Priority Data

Dec. 27, 2016 (CN) ..... 201611225466.7

(51) Int. Cl.
*E05F 15/603* (2015.01)
*E05F 1/08* (2006.01)
(Continued)

(52) U.S. Cl.
CPC ..... *E05F 15/603* (2015.01); *E05F 1/08* (2013.01); *F25D 23/028* (2013.01);
(Continued)

(58) Field of Classification Search
CPC ..... E05F 15/603; E05F 1/08; E05F 15/619; E05F 1/10; E05F 15/614; F25D 23/028;
(Continued)

(56) References Cited

U.S. PATENT DOCUMENTS 9,879,463 B2 * 1/2018 Lombrozo ..... E05F 15/79
9,909,800 B2 * 3/2018 Jung ..... F25D 23/028
(Continued)

FOREIGN PATENT DOCUMENTS

CN 101043167 A 9/2007
CN 101985979 A 3/2011
(Continued)

*Primary Examiner* — Hanh V Tran
(74) *Attorney, Agent, or Firm* — Cheng-Ju Chiang

(57) ABSTRACT

The present invention discloses an automatic door opening device and a refrigerator having the same. The automatic door opening device comprises a base, a driving source member, two mechanical clutch gear sets and two pushing members, wherein the mechanical clutch gear set comprises a mechanical master gear, a mechanical slave gear, and a mechanical clutch member; in an initial state, the mechanical master gear is partially meshed with the mechanical clutch member which is separated from the mechanical slave gear; in a door body opening process, the mechanical master gear drives the mechanical slave gear to be in a transmission state; and after the door body is opened, the mechanical clutch gear set is recovered to an initial connection state.

8 Claims, 9 Drawing Sheets

(51) Int. Cl.
*F25D 23/02* (2006.01)
*F25D 25/02* (2006.01)

(52) U.S. Cl.
CPC ..... *F25D 25/025* (2013.01); *E05Y 2900/31* (2013.01); *F25D 2323/02* (2013.01)

(58) Field of Classification Search
CPC ..... F25D 25/025; F25D 2323/02; E05Y 2900/31; E05Y 2201/216; E05Y 2201/426; E05Y 2201/624
See application file for complete search history.

(56) References Cited

U.S. PATENT DOCUMENTS

| | | | | |
|---|---|---|---|---|
| 10,301,864 | B2 * | 5/2019 | Yasaka | F25D 23/028 |
| 10,407,977 | B2 * | 9/2019 | Fraser | E05F 15/619 |
| 10,422,176 | B2 * | 9/2019 | Carli | A47L 15/4259 |
| 10,578,349 | B2 * | 3/2020 | Kim | F25D 23/02 |
| 10,731,398 | B2 * | 8/2020 | Sugita | F16D 65/22 |
| 11,029,078 | B2 * | 6/2021 | Lee | E05F 15/616 |
| 11,072,960 | B2 * | 7/2021 | Lee | F25D 23/02 |
| 11,085,223 | B2 * | 8/2021 | Oestermann | E05F 15/79 |
| 11,112,170 | B2 * | 9/2021 | Murata | G06Q 10/087 |
| 11,125,005 | B2 * | 9/2021 | Yao | E05F 15/70 |
| 2011/0048060 | A1 * | 3/2011 | Kim | E05B 17/0029 62/449 |
| 2011/0083461 | A1 * | 4/2011 | Kim | E05F 15/619 62/449 |
| 2013/0154461 | A1 * | 6/2013 | Bohle | E05F 15/614 312/319.6 |
| 2014/0150581 | A1 * | 6/2014 | Scheuring | B60J 5/047 74/89.38 |
| 2015/0027247 | A1 * | 1/2015 | Kamada | F25D 25/025 74/30 |
| 2016/0312516 | A1 * | 10/2016 | Heydel | H02K 7/116 |
| 2016/0313050 | A1 * | 10/2016 | Yoon | F25D 23/02 |
| 2018/0119475 | A1 * | 5/2018 | Kim | E05F 15/614 |
| 2019/0330909 | A1 * | 10/2019 | Lee | F25D 29/008 |
| 2021/0278125 | A1 * | 9/2021 | Wang | B65B 31/048 |

FOREIGN PATENT DOCUMENTS

| | | | | | |
|---|---|---|---|---|---|
| CN | 102543503 | A | | 7/2012 | |
| CN | 102635997 | A | | 8/2012 | |
| CN | 102953595 | A | | 3/2013 | |
| CN | 104121748 | A | | 10/2014 | |
| CN | 104328971 | A | | 2/2015 | |
| CN | 105113905 | A | | 12/2015 | |
| CN | 105971439 | A | | 9/2016 | |
| CN | 106014062 | A | | 10/2016 | |
| CN | 106050047 | A | | 10/2016 | |
| CN | 106761136 | A | | 5/2017 | |
| CN | 106766591 | A | | 5/2017 | |
| JP | 2000320955 | A | * | 11/2000 | |
| JP | 2003-185333 | A | | 7/2003 | |
| JP | 2003-247775 | A | | 9/2003 | |
| JP | 2015055130 | A | * | 3/2015 | F25D 23/02 |
| JP | 2015055437 | A | * | 3/2015 | F25D 23/02 |

* cited by examiner

AUTOMATIC DOOR OPENING DEVICE AND REFRIGERATOR HAVING THE SAME

The present application is a 35 U.S.C. § 371 National Phase conversion of International (PCT) Patent Application No. PCT/CN2017/118853, filed on Dec. 27, 2017, which claims the priority of the Chinese patent application No. 201611225466.7 filed on Dec. 27, 2016 and titled "Automatic Door Opening Device and Refrigerator Having the Same", which is incorporated herein in its entirety by reference. The PCT International Patent Application was filed and published in Chinese.

TECHNICAL FIELD

The present invention belongs to the technical field of household appliance manufacturing, and particularly relates to an automatic door opening device and a refrigerator having the same.

BACKGROUND

At present, due to relatively larger sizes, middle-high-grade refrigerators on the market require larger refrigerator door bodies, heavier door body load, and higher door seal suction for the door bodies or drawer-type door bodies. As a result, more and more users report a problem that the refrigerator door bodies are difficult to open. Aiming at this problem, an electric opening device appears.

In a process of opening a refrigerator door body by the existing electric opening device, a screw rod is driven by an electric motor to rotate forward to be meshed with a gear assembly, thereby enabling a rack pushing rod to drive the door body to be opened. After the door body is opened, the screw rod is driven by the electric motor to rotate backward to be meshed with the gear assembly, thereby resetting the rack pushing rod. However, for this existing electric opening device, noise is larger as the gear assembly needs to be meshed with the screw rod again in the resetting process of the rack pushing rod.

Therefore, it is necessary to provide an improved automatic door opening device and a refrigerator having the same to solve the above problem.

SUMMARY

An object of the present invention is to provide an automatic door opening device and a refrigerator having the same.

In order to achieve the above object, an embodiment of the present invention provides an automatic door opening device, including: a base, a driving source member fixed in the base, two pushing members which have the same structure and are configured to push a door body to be opened, and a transmission body configured to mesh the driving source member with the two pushing members.

The pushing member includes: a pushing rod and a first elastic member connected to the pushing rod and arranged away from the door body.

The transmission body includes: two mechanical clutch gear sets which are meshed with the two pushing members respectively and have the same structure, wherein the mechanical clutch gear set includes a mechanical master gear meshed with the driving source member, a mechanical slave gear meshed with one of the pushing members, and a mechanical clutch member configured to selectively connect the mechanical master gear and the mechanical slave gear.

In an initial state, the mechanical master gear is partially engaged with the mechanical clutch member, and is partially meshed with the mechanical clutch member; and the mechanical clutch member is separated from the mechanical slave gear.

In a door body opening process, the mechanical master gear of one of the at least two mechanical clutch gear sets is partially engaged with the mechanical clutch member which is meshed with the mechanical slave gear; and the driving source member drives the mechanical master gear to drive the mechanical slave gear to be in a transmission state, so that the pushing rod corresponding to the mechanical slave gear is driven to move toward the outside of the base to open the door body, and an acting force toward a distal end of the door body is applied to the first elastic member.

After the door body is opened, the mechanical clutch gear set that currently drives the door body to be opened is recovered to an initial connection state; the mechanical master gear is in a stationary state; and the first elastic member applies a tensioning force to the corresponding pushing rod, so that the pushing rod is driven to move toward the inside of the base, and the mechanical slave gear corresponding to the pushing rod is driven to rotate backward.

As an improvement of the embodiment of the present invention, the two pushing members are symmetrically close to two opposite side walls of the base, respectively; the two mechanical clutch gear sets are symmetrically arranged between the two pushing members; the driving source member is arranged between the two mechanical clutch gear sets; and meshing teeth on the two mechanical clutch gear sets are arranged in opposite directions.

As a further improvement of the embodiment of the present invention, the mechanical master gear, the mechanical slave gear and the mechanical clutch member in each mechanical gear set are arranged coaxially.

As a further improvement of the embodiment of the present invention, the mechanical clutch member includes: a mechanical clutch portion and a second elastic member that stretches and shrinks in the axial direction of the mechanical clutch portion.

One end of the second elastic member is detachably connected to the mechanical clutch portion, and the other end of the second elastic member is movably connected to the mechanical master gear or the base.

In an initial state, the mechanical master gear is partially engaged with the mechanical clutch member, and is partially meshed with the mechanical clutch member; and the mechanical clutch member is separated from the mechanical slave gear.

In a door body opening process, the mechanical master gear is partially engaged with the mechanical clutch member which is meshed with the mechanical slave gear; and the second elastic member applies an acting force toward the direction of the mechanical master gear to the mechanical clutch portion.

After the door body is opened, the second elastic member applies a tensioning force to the mechanical clutch portion to drive the mechanical clutch portion to move toward the direction of the mechanical master gear, so that the initial state is recovered.

As a further improvement of the embodiment of the present invention, a through hole is axially formed in the mechanical clutch portion, and one end of the second elastic member is engaged in the through hole.

As a further improvement of the embodiment of the present invention, the mechanical clutch portion includes: an annularly-cylindrical mechanical clutch portion main body.

An end surface of the mechanical clutch portion main body close to the mechanical slave gear is arranged as a first annularly-stepped slope composed of a plurality of slope-shaped steps.

A first accommodating groove with a ring-shaped radial cross section is formed in an end surface of the mechanical clutch portion main body close to the mechanical master gear.

The bottom wall of the first accommodating groove is arranged as a second annularly-stepped slope composed of a plurality of slope-shaped steps.

At least two second limiting protrusions are evenly arranged on an end surface of the mechanical clutch portion main body close to the mechanical master gear, and are close to an outer wall side of the mechanical clutch portion main body.

A height difference exists between the start and the end of each slope-shaped step in each annularly-stepped slope in the axial direction of the mechanical clutch portion; and the starts of the all slope-shaped steps are located in the same plane, and the ends of the all slope-shaped steps are located in the same plane.

In the first annularly-stepped slope, the all slope-shaped steps are connected clockwise or counterclockwise.

In the second annularly-stepped slope, a connecting direction of the all slope-shaped steps is opposite to that of the all slope-shaped steps in the first annularly-stepped slope.

As a further improvement of the embodiment of the present invention, the mechanical slave gear includes: a mechanical slave gear connecting portion, and a mechanical slave gear meshing portion extending from the mechanical slave gear connecting portion.

A plurality of meshing teeth is arranged on an outer wall of the mechanical slave gear meshing portion.

A second accommodating groove with a ring-shaped radial cross section is formed in an end surface of the mechanical slave gear connecting portion away from the mechanical slave gear meshing portion.

The mechanical slave gear connecting portion further includes: a first supporting rotating shaft perpendicularly extending outwards from the center of the second accommodating groove, and a third annularly-stepped slope which is formed on the bottom wall of the second accommodating groove and is composed of a plurality of slope-shaped steps.

The second elastic member sleeves the supporting rotating shaft.

In the door body opening process, the first annularly-stepped slope is meshed with the third annularly-stepped slope to maintain the mechanical clutch member and the mechanical slave gear in a relatively stationary state.

As a further improvement of the embodiment of the present invention, the mechanical master gear has a ring-shaped diameter cross section; and a plurality of arc-shaped accommodating holes having the same structure is formed in the mechanical master gear at an equal interval, and runs through the two end surfaces of the mechanical master gear, so that the mechanical master gear is radially divided into an inner ring stage and an outer ring stage connected to each other.

A plurality of meshing teeth is arranged on an outer wall of an end of the outer ring stage away from the mechanical slave gear.

The second limiting protrusion is always movably arranged in the corresponding arc-shaped accommodating hole.

An end surface of the inner ring stage close to the mechanical clutch member is arranged as a fourth annularly-stepped slope composed of a plurality of slope-shaped steps.

In the initial state, the second annularly-stepped slope is meshed with the fourth annularly-stepped slope.

As a further improvement of the embodiment of the present invention, the transmission body further includes: at least one set of transmission wheels corresponding to each mechanical clutch gear set.

Each set of the transmission wheels is simultaneously meshed with the corresponding pushing member and mechanical clutch gear set; and/or each set of the transmission wheels is simultaneously meshed with the corresponding mechanical clutch gear set and the driving source member.

In order to achieve one of the above objects, embodiments of the present invention provide a refrigerator, including: a refrigerator body having a compartment, a drawer arranged on the refrigerator body, and a door body for opening or closing the compartment; and the refrigerator is further provided with the above-described automatic door opening device to open the drawer or the door body.

Compared with the prior art, the present invention has the following technical effects. In the automatic door opening device provided by the present invention, the pushing member can be automatically recovered to the initial state through the first elastic member arranged in the pushing member after the pushing member drives the door body to be opened. Further, through the two mechanical clutch gear sets with the same structure, noise indirectly generated to the driving source member in the resetting process of the pushing member is avoided. Meanwhile, in the automatic door opening device adopting the above structure, after the door body is opened, there is no need to electrically drive the pushing member to be reset, so that the power consumption and the component cost of the automatic door opening device are reduced. Moreover, in the door body opening process, the two clutch gear sets are driven by the electric motor to rotate simultaneously to open the two door bodies at the same time, so that the power consumption and the component cost of the automatic door opening device are further reduced. Therefore, the user experience is excellent, and users can conveniently operate and control the refrigerator.

DETAILED DESCRIPTION

The present invention will be described in detail below with reference to all embodiments shown in the accompanying drawings. However, these embodiments are not intended to limit the present invention, and changes of structures, methods or functions, made by ordinary person skilled in the art in accordance with these embodiments are all included within the protection scope of the present invention.

Figure 1:
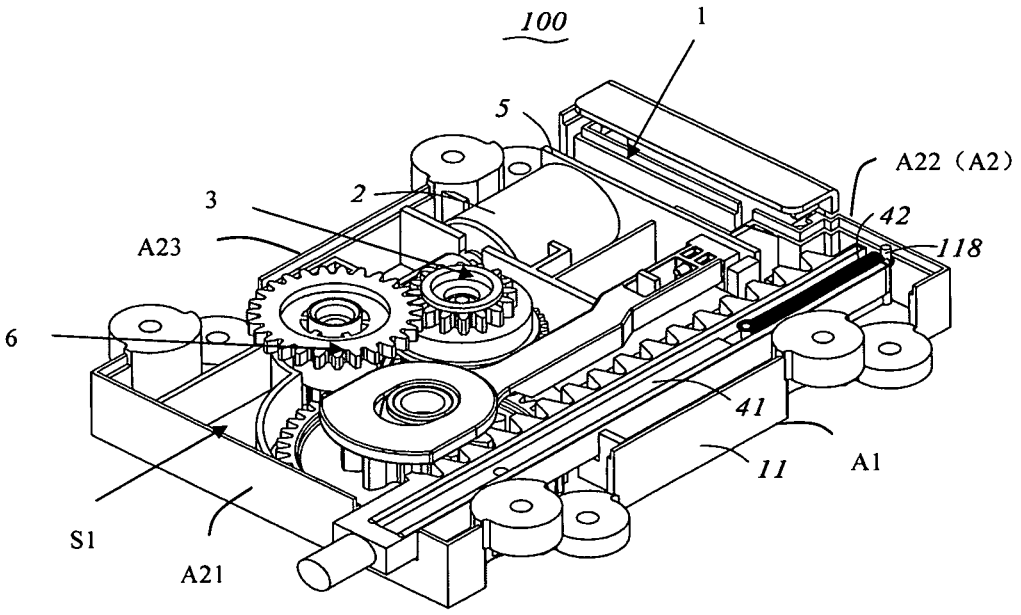
FIG. 1 is a schematically structural view of an automatic door opening device without a cover body according to a first embodiment of the present invention.
Figure 2:
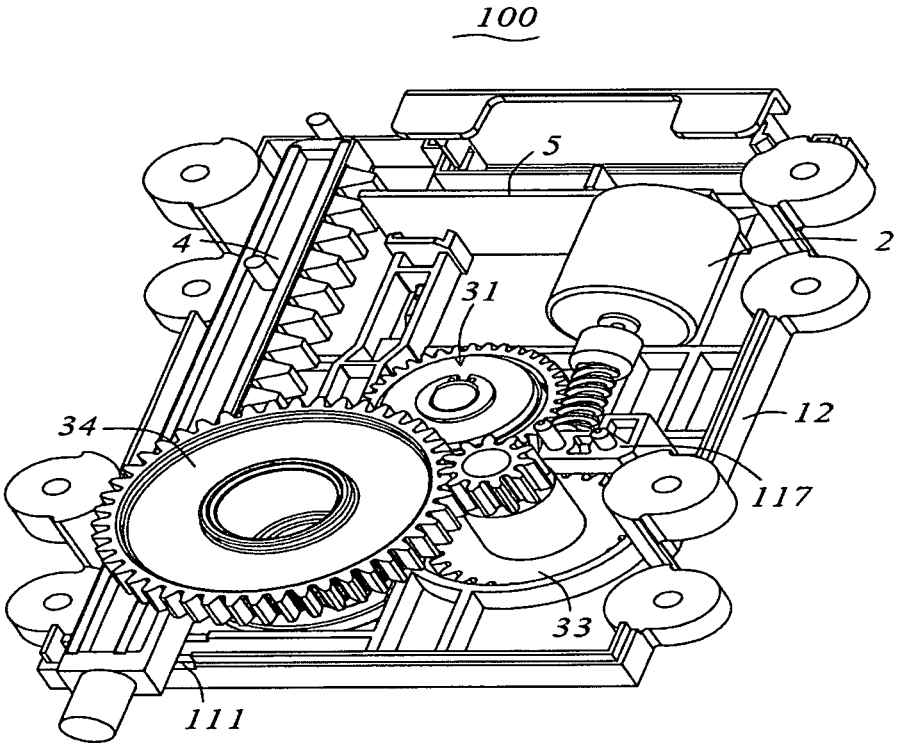
FIG. 2 is a schematically structural view of the automatic door opening device without a box body according to the first embodiment of the present invention.
Figure 3:
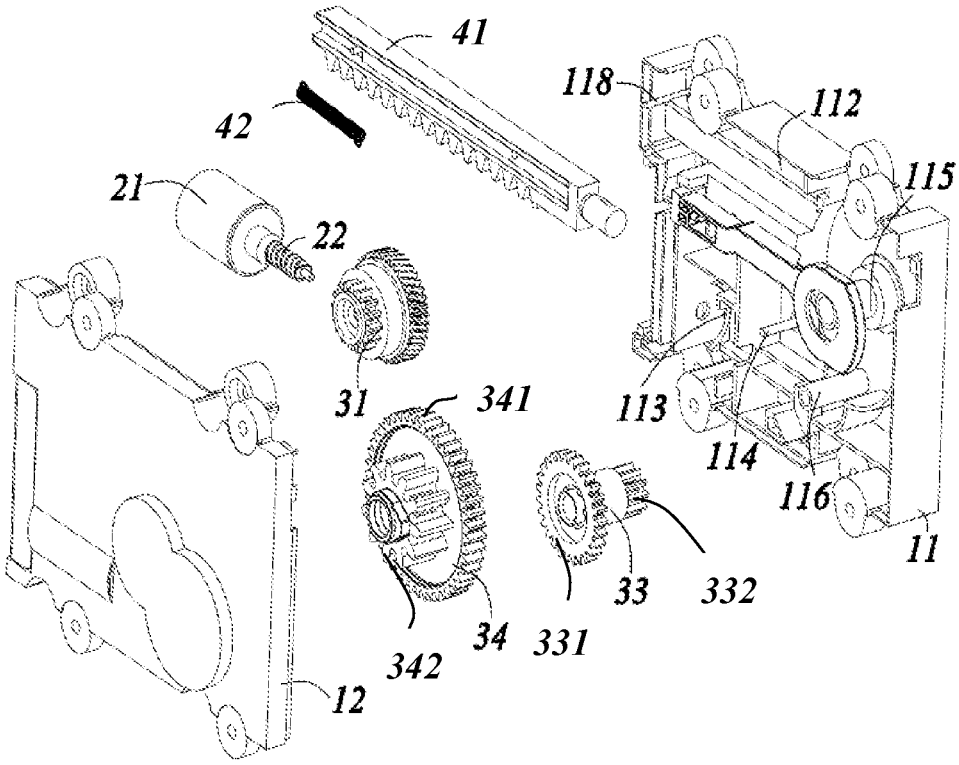
FIG. 3 is a schematically structural explosion view of the automatic door opening device according to the first embodiment of the present invention.
Figure 4:
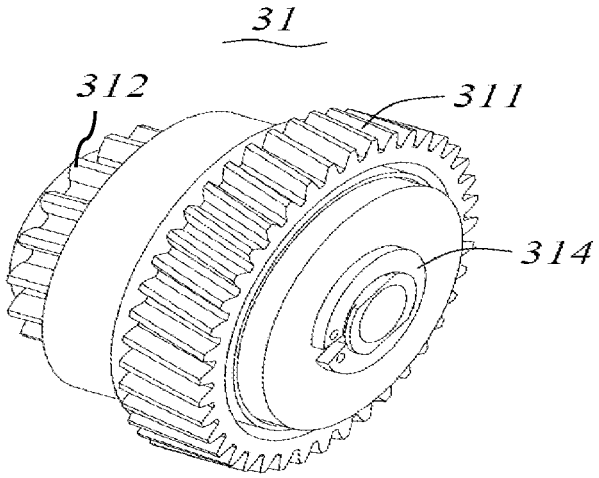
FIG. 4 is a schematically structural view of an electric clutch device according to the first embodiment of the present invention.
Figure 5:
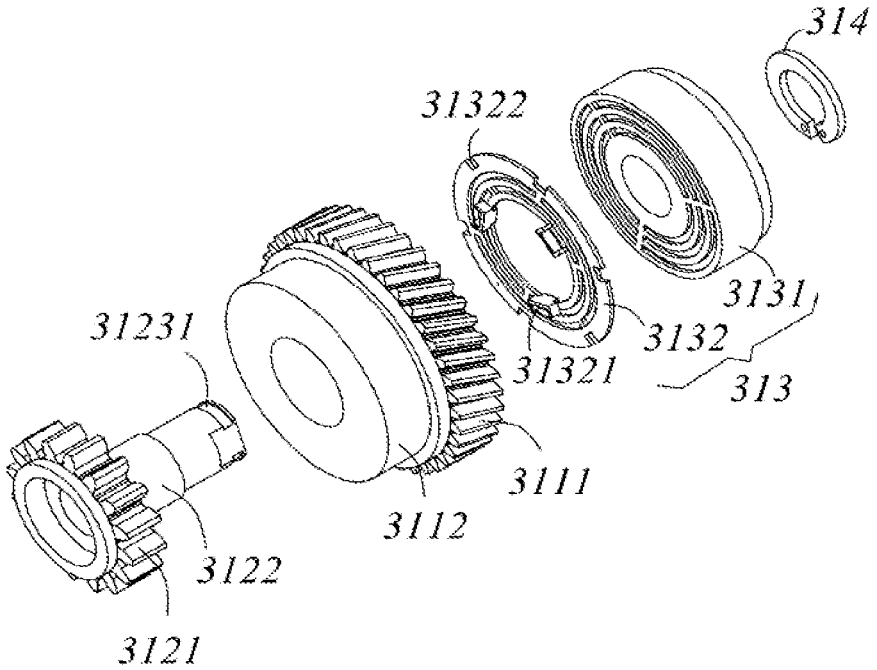
FIG. 5 is a schematically structural explosion view of the device shown in FIG. 4.
Figure 6:
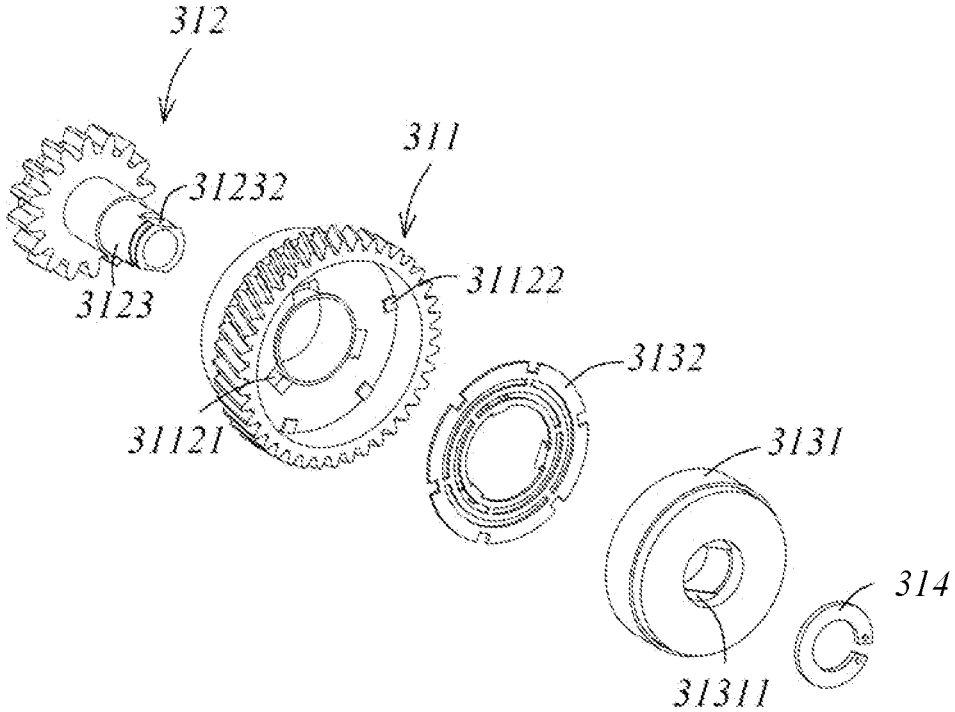
FIG. 6 is a schematically structural explosion view of the device shown in FIG. 4 from another direction.
Figure 7:
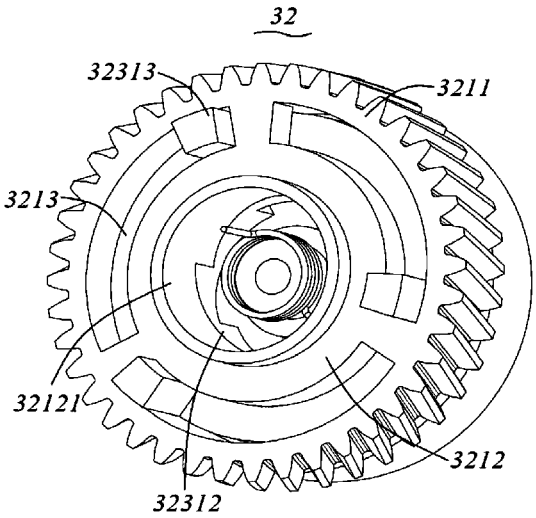
FIG. 7 is a schematically structural view of a mechanical clutch device in an initial state according to a second embodiment of the present invention.
Figure 8:
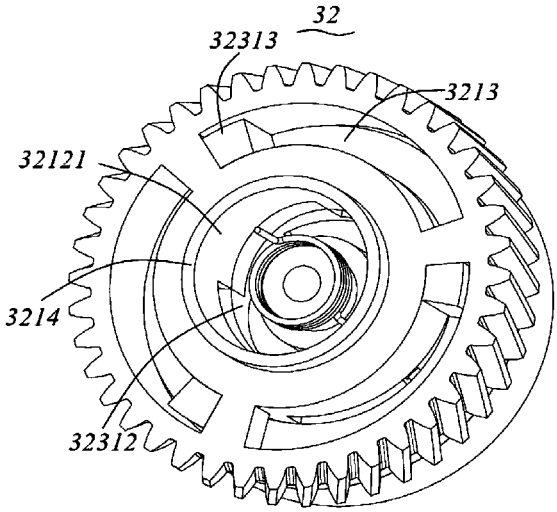
FIG. 8 is a schematically structural view of the mechanical clutch device in a door body opening process according to the second embodiment of the present invention.
Figure 9:
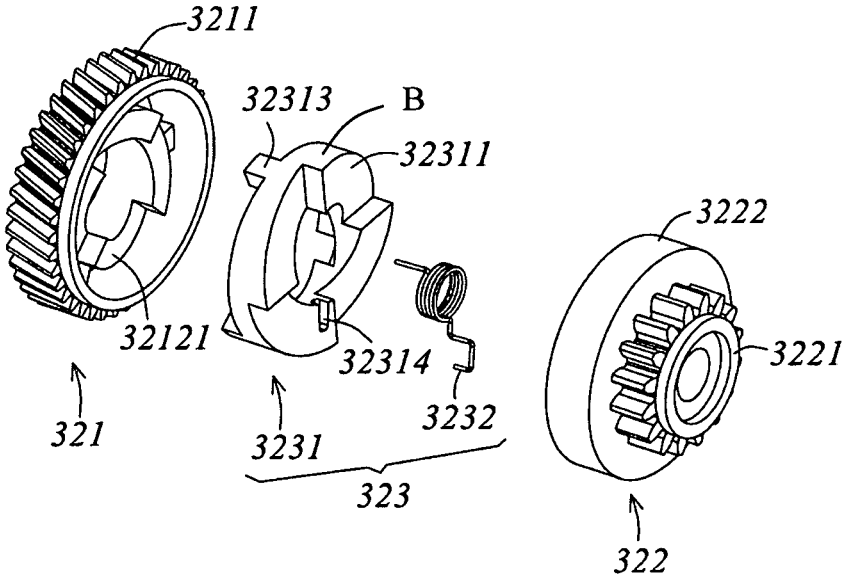
FIG. 9 is a schematically structural explosion view of the mechanical clutch device according to the second embodiment of the present invention.
Figure 10:
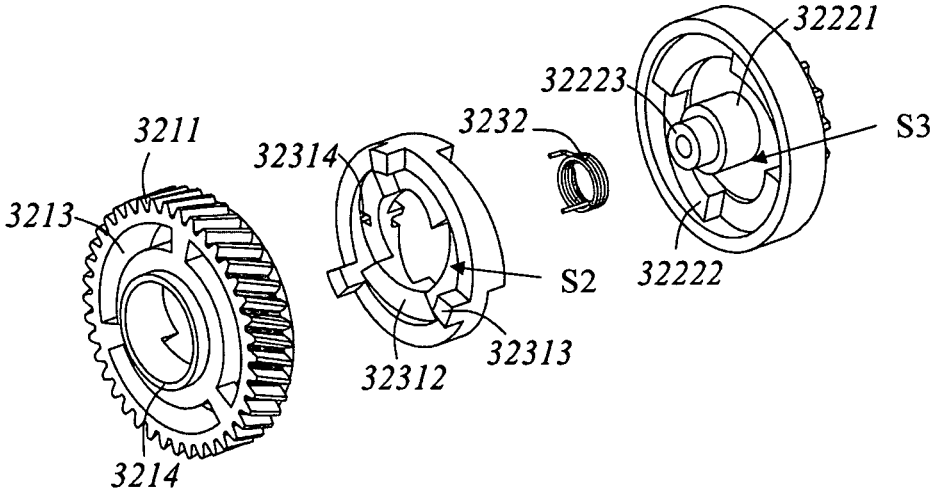
FIG. 10 is a schematically structural explosion view of the device shown in FIG. 9 from another direction.

FIGS. 1 to 3 show a preferred embodiment of an automatic door opening device 100 provided by the present invention. The automatic door opening device 100 can be applied to any equipment that needs to be opened electrically, such as a refrigerator, and is mounted at the rear of a door body or a door body of a drawer of the equipment, so that the door body or the door body of the drawer of the equipment is opened in a pushing manner.

The automatic door opening device 100 includes a base 1, a driving source member 2 fixed in the base 1, a pushing member 4 partially movably arranged in the base 1 and configured to push the door body to be opened, and a transmission body 6 arranged between the driving source member 2 and the pushing member 4. It should be noted that in the specific embodiments of the present invention, the automatic door opening device 100 further includes a control panel 5 configured to receive a door body opening signal, and thus to control the automatic door opening device to operate, which will be described in detail below.

The transmission body 6 includes: two portions, namely a first portion and a second portion which are selectively connected to each other. The first portion is connected to the driving source member 2, and the second portion is connected to the pushing member 4. When the door body opening signal is received, the first portion and the second portion of the transmission body 6 are connected to be in a transmission state; and the driving source member 2 drives the transmission body 6 to move, so that the pushing member 4 is driven to move toward a direction of the door body to open the door body. After the door body is opened, the first portion and the second portion of the transmission body 6 are disengaged from the transmission state; the first portion maintains a stationary state; and the pushing member 4 moves toward a direction away from the door body, and drives the second portion of the transmission body 6 to move.

The base 1 is a rectangular box-like structure, including: a box body 11 and a cover body 12 which are fastened together, as well as an accommodating cavity S1 formed between the box body 11 and the cover body 12. The box body 11 includes a bottom wall A1 facing the cover body 12 and peripheral walls A2 respectively extending from the periphery of the bottom wall A1 toward the cover body 12. The peripheral walls A2 include a front wall A21 and a rear wall A22 opposite to each other, and two side walls A23 opposite to each other. An opening 111 allowing the pushing member 4 to extend out is formed in the front wall.

In a preferred embodiment of the present invention, the opening 111 is close to any one of the side walls of the box body 11, so that the inner space of the base 1 can be used reasonably. An end of each of the two side walls close to the rear wall of the box body 11 further extends outwards to allow a screw fixing hole to be formed therein; and penetrating holes corresponding to the screw fixing holes are formed in the cover body 12, so that the box body 11 and the cover body 12 are fixed together through screws penetrating through the penetrating holes and the screw fixing holes; and meanwhile, the automatic opening device 100 of the present invention is fixed to corresponding equipment.

An elongated guiding groove 112 extending longitudinally protrudes from a position of the bottom wall of the box body 11 close to one of the two side walls. One end of the guiding groove 112 corresponds to the opening 111. An electric motor fixing groove 113 is formed at a position of the bottom wall close to the rear wall of the box body 11. A first rotating shaft 114, a second rotating shaft 115 and a third rotating shaft 116 are arranged at the same side of the guiding groove 112 whose axle centers can form a triangle after being connected. The first rotating shaft 114 is close to the electric motor fixing groove 113; and the third rotating shaft 116 is close to the elongated guiding groove 112. An electric motor fixing block 117 is further arranged on the bottom wall of the box body 11, and cooperates with the electric motor fixing groove 113 to limit the position of the driving source member 2. A bracket 118 is further arranged at a position, close to the rear wall, of the bottom wall A1 of the box body 11, and cooperates with the guiding groove 112 to limit the position of the pushing member 4.

In the present embodiment, the driving source member 2 includes an electric motor 21 fixedly arranged in the electric motor fixing groove 113 of the base 1, and a worm 22 erected on the electric motor fixing block 117 and arranged at the output end of the electric motor 21. When the electric motor 21 is in operation, the worm 22 is meshed with the transmission body 6, so that the transmission body 6 is driven by the worm 22, thereby driving the pushing member 4 to open the door body.

In the present embodiment, the pushing member 4 includes: a pushing rod 41 movably arranged in the elongated guiding groove 112 and close to the opening 111, and a first elastic member 42 whose one end is connected to the pushing rod 41 and the other end is close to the end of the elongated guiding groove 112 away from the opening 111. A linear rack is arranged at a side of the pushing rod 41 close to the transmission body 6, so as to be meshed with the transmission body 6. One end of the first elastic member 42 is fixed to the bracket 118. Of course, in other embodiments of the present invention, the other end of the first elastic member 42 may also be fixedly connected into the elongated guiding groove 112, and details will not be repeated herein.

When the door body opening signal is received, the pushing rod 41 drives the first elastic member 42 to move toward the outside of the base 1 to open the door body; and the first elastic member 42 applies an acting force toward the inside of the base 1 to the pushing rod 41. After the door body is opened, the first elastic member 42 applies a tensioning force to the pushing rod 41 to drive the pushing rod to move toward the inside of the base 1.

As shown in FIGS. 3 to 6, in the first embodiment of the present invention, the transmission body 6 includes: an electric clutch gear set 31 movably sleeving the first rotating shaft 114; the electric clutch gear set 31 includes: an electric master gear 311 meshed with the driving source member 2, an electric slave gear 312 meshed with the pushing member 4, and an electric clutch member 313 configured to selectively connect the electric master gear 311 and the electric slave gear 312.

When the door body opening signal is received, the driving source member 2 and the electric clutch member 313 are simultaneously powered on, and the electric master gear 311 and the electric slave gear 312 are detachably fixedly connected through the electric clutch member 313. The driving source member 2 drives the electric master gear 311 to drive the electric slave gear 312 to be in a transmission state, so that the pushing rod 41 is driven to move toward the outside the base 1 to open the door body; and an acting force toward the inside of the base 1 is applied to the first elastic member 42.

After the door body is opened, the driving source member 2 and the electric clutch member 313 are powered off simultaneously, and the electric master gear 311 and the electric slave gear 312 are disengaged from the transmission state through the electric clutch member 313. At this time, the electric master gear 311 is in a stationary state, and the first elastic member 42 applies a tensioning force to the pushing rod 41 to enable the pushing rod 41 to move toward the inside of the base 1 and drive the electric slave gear 312 to rotate backward. Thus, in the backward rotating process of the electric slave gear 312, the electric master gear 311 maintains the stationary state, so that noise caused by meshing between the electric master gear 311 and the worm 22 is avoided.

In a specific embodiment of the present invention, the electric clutch member 313 includes: an electric clutch 3131 and an electric clutch plate 3132 which are abutted against each other. The electric clutch 3131 is detachably connected to the electric slave gear 312; and the electric clutch plate 3132 is detachably connected to the electric master gear 311. When the door body opening signal is received, the electric clutch member 313 is powered on; and the electric clutch 3131 and the electric clutch plate 3132 attract each other to enable the electric master gear 311 and the electric slave gear 312 to be detachably fixedly connected. After the door body is opened, the electric clutch member 313 is powered off; and the electric clutch 3131 and the electric clutch plate 3132 are separated from each other to enable the electric master gear 311 and the electric slave gear 312 to be disengaged from the transmission state. Further, in the process of driving the pushing rod 41 back into the base 1 under the recovering force of the first elastic member 42, it is ensured that the electric slave gear 312 rotates, while the electric master gear 311 is stationary. Thus, the noise caused by meshing between the electric master gear 311 and the worm 22 is avoided.

Preferably, the electric clutch 3131 is annularly-cylindrical; and at least one stopping piece 31311 extending toward a central axis direction of the electric clutch 3131 is arranged on the inner wall surface of the annularly-cylindrical electric clutch 3131. Preferably, at least one connecting hook 31321 is arranged at one side of the electric clutch plate 3132 close to the electric master gear 311; and at least one limiting groove 31322 is formed in the outer wall of the electric clutch plate 3132. In a specific embodiment of the present invention, the number of connecting hooks 31321 is three, wherein centers of the connecting hooks form an equilateral triangle after being connected by lines; and the number of the limiting grooves 31322 is an even number, and the limiting grooves 31322 are equally spaced on the outer wall of the electric clutch plate 3132.

In a preferred embodiment of the present invention, the electric slave gear 312, the electric master gear 311 and the electric clutch member 313 are coaxially arranged. A meshing radius of the electric master gear 311 is greater than that of the electric slave gear 312; and the number of meshing teeth of the electric master gear 311 is greater than that of meshing teeth of the electric slave gear 312. Thus, input power of the driving source member 2 is reduced, and the power consumption and the component cost of the automatic door opening device are reduced.

The electric slave gear 312 includes: an electric slave gear meshing portion 3121, and an electric slave gear connecting portion extending from the electric slave gear meshing portion 3121. A plurality of meshing teeth is arranged on the outer wall of the electric slave gear meshing portion 3121. The electric slave gear connecting portion includes: a first connecting portion 3122 extending from the electric slave gear meshing portion, and a second connecting portion 3123 extending from the first connecting portion 3122. The electric slave gear meshing portion 3121, the first connecting portion 3122 and the second connecting portion 3123 are coaxially arranged. A radial diameter of the first connecting portion 3122 is greater than that of the second connecting portion 3123. Thus, the positions of the electric master gear 311 and the electric clutch member 313 can be fixed conveniently.

The electric slave gear meshing portion 3121 is meshed with the pushing rod 41; the electric master gear 311 is partially fit with and sleeves the first connecting portion 3122; the electric clutch plate 3132 is fit with and sleeves an end of the first connecting portion 3122 away from the electric slave gear meshing portion 3121; and the electric clutch 3131 is fit with and sleeves the second connecting portion 3123.

In a preferred embodiment of the present invention, a first positioning groove 31231 is formed in an end of the second connecting portion 3123 away from the electric slave gear meshing portion 3121. The electric clutch gear set 31 further includes a stopping ring 314. The stopping ring 314 is arranged in the first positioning groove 31231; one end surface of the stopping ring 314 is abutted against an end surface of the electric clutch 3131; and an outer diameter of the stopping ring 314 is larger than that of the second connecting portion 3122, so that the axial positions of the electric master gear 311 and the electric clutch member 313 relative to the electric slave gear 312 are fixed.

In a preferred embodiment of the present invention, a stopping groove 31232 is further formed in the second connecting portion 3123; and the stopping groove 31232 and the stopping piece 31311 are fit with each other, so as to fix the radial position of the electric clutch member 313 relative to the electric slave gear 312.

In an embodiment of the present invention, the electric master gear 311 includes: an electric master gear meshing portion 3111 meshed with the driving source member 2, wherein a diameter cross section of the inner wall of the electric master gear meshing portion 3111 is circular; an electric master gear connecting portion 3112, wherein a portion of the electric master gear connecting portion 3112 is fixed to the inner wall of the electric master gear meshing portion 3111 in a fit inserting manner, and a portion of the electric master gear connecting portion 3112 protrudes outside the electric master gear meshing portion 3111. A plurality of meshing teeth is formed on the outer wall of the electric master gear meshing portion 3111, and the electric master gear connecting portion 3112 is an annular cylinder that is fit with and sleeves the first connecting portion 3122.

A plurality of connecting clamping grooves 31121 is formed in the end surface of the electric master gear connecting portion 3112 inserted into the electric master gear meshing portion 3111, and is close to an inner side wall of the electric master gear connecting portion 3112. The number of the connecting clamping grooves 31121 is the same as that of the connecting hooks 31321; and the connecting clamping grooves 31121 and the connecting hooks 31312 are in fit connection with each other to detachably fix the electric clutch plate 3132 to the electric master gear 311.

A plurality of limiting protrusions 31122 is further arranged on the end surface of the electric master gear connecting portion 3112 inserted into the electric master gear meshing portion 3111, and is close to an outer side wall of the electric master gear connecting portion 3112. The number of the limiting protrusions 31122 is the same as that of the limiting grooves 31322; and the limiting protrusions 31122 and the limiting grooves 31322 are fit with each other to fix a radial position of the electric clutch plate 3132 relative to the electric master gear 311.

In other preferred embodiments of the present invention, the transmission body 6 further includes: at least one set of transmission wheels which are simultaneously meshed with the pushing member 4 and the clutch gear set 3, and/or which are simultaneously meshed with the clutch gear set 3 and the driving source member 2.

The transmission wheel may adopt various structures. Each set of transmission wheels may include a plurality of slave transmission wheels. In a specific example of the present invention, each set of the transmission wheels includes two slave transmission wheels; one of the two slave transmission wheels is meshed with the pushing member 4, and the other slave transmission wheel is meshed with the clutch gear set 3; and/or one of the two slave transmission wheels is meshed with the driving source member 2, and the other slave transmission wheel is meshed with the clutch gear set 3. The two slave gear sets may be arranged coaxially or eccentrically. The number of meshing teeth of the two slave gears may be the same or different. The sizes of the two slave gears may be the same or different. In addition, the outer shape of the two slave gears may be circular or special-shaped. Details will not be repeated herein.

In a specific example of the present invention, there are two sets of transmission wheels, namely a first transmission wheel set 33 and a second transmission wheel set 34 which sleeve the second rotating shaft 115 and the third rotating shaft 116, respectively. The first transmission wheel set 33 includes a first slave transmission wheel 331 and a second slave transmission wheel 332 arranged coaxially. The second transmission wheel set 34 includes a third slave transmission wheel 341 and a fourth slave transmission wheel 342 arranged coaxially. The electric slave gear 312 is meshed with the first slave transmission wheel 331; the second slave transmission wheel 332 is meshed with the third slave transmission wheel 341; and the fourth slave transmission wheel 342 is meshed with the pushing rod 41. The number of meshing teeth of the first slave transmission wheel 331 is greater than that of meshing teeth of the second slave transmission wheel 332; and the number of meshing teeth of the third slave transmission wheel 341 is greater than that of meshing teeth of the fourth slave transmission wheel 342. Thus, input power of the driving source member 2 is reduced, and the power consumption and the component cost of the automatic door opening device are reduced.

In the automatic door opening device provided by the first embodiment of the present invention, the pushing member can be automatically recovered to the initial state through the first elastic member arranged in the pushing member after the pushing member drives the door body to be opened. Further, through the electric clutch gear set, noise indirectly generated to the driving source member in the resetting process of the pushing member is avoided. Meanwhile, in the automatic door opening device adopting the above structure, after the door body is opened, there is no need to electrically drive the pushing member to be reset, so that the power consumption and the component cost of the automatic door opening device are reduced.

As shown in FIGS. 7 to 10, an automatic door opening device according to a second embodiment of the present invention is similar to the automatic door opening device according to the first embodiment except that the electric clutch gear set 31 in the above transmission body 6 is arranged as the mechanical clutch gear set 32 which movably sleeves the first rotating shaft 114.

The mechanical clutch gear set 32 includes a mechanical master gear 321 meshed with the driving source member 2, a mechanical slave gear 322 meshed with the pushing member 4, and a mechanical clutch member 323 configured to selectively connect the mechanical master gear 321 and the mechanical slave gear 322.

When the door body opening signal is received, the driving source member 2 is powered on, and the mechanical master gear 321 and the mechanical slave gear 322 are detachably fixedly connected through the mechanical clutch member 323. The driving source member 2 drives the mechanical master gear 321 to drive the mechanical slave gear 322 to be in a transmission state, so that the pushing rod 41 is driven to move toward a door body direction to open the door body; and an acting force toward a distal end of the door body is applied to the first elastic member 42.

After the door body is opened, the driving source member 2 is powered off, and the mechanical master gear 321 and the mechanical slave gear 322 are disengaged from the transmission state through the mechanical clutch member 323. At this time, the mechanical master gear 321 is in a stationary state, and the first elastic member 42 applies a tensioning force to the pushing rod 41 to enable the pushing rod 41 to move toward a distal end direction of the door body and drive the mechanical slave gear 322 to rotate backwards. Thus, in the backward rotating process of the mechanical slave gear 322, the mechanical master gear 321 maintains the stationary state, so that noise caused by meshing between the mechanical master gear 321 and the worm 22 is avoided.

In a specific embodiment of the present invention, the mechanical master gear 321, the mechanical slave gear 322 and the mechanical clutch member 323 are coaxially arranged.

The mechanical clutch member 323 includes: a mechanical clutch portion 3231 and a second elastic member 3232 that stretches and shrinks in the axial direction of the mechanical clutch portion 3231. One end of the second elastic member 3232 is detachably connected to the mechanical clutch portion 3231, and the other end of the second elastic member 3232 is movably connected to the mechanical master gear 321 or the base 1. In an initial state, the mechanical master gear 321 is partially engaged with the mechanical clutch member 323, and is partially meshed with the mechanical clutch member 323; and the mechanical clutch member 323 is separated from the mechanical slave gear 322. In the door body opening process, the mechanical master gear 321 is partially engaged with the mechanical clutch member 323 which is meshed with the mechanical slave gear 322; the second elastic member 3232 applies an acting force toward the direction of the mechanical master gear 321 to the mechanical clutch portion 3231. After the door body is opened, the second elastic member 3232 applies a tensioning force to the mechanical clutch portion 3231 to drive the mechanical clutch portion 3231 to move toward the direction of the mechanical master gear 321, so that the initial state is recovered.

Preferably, the mechanical clutch portion 3231 includes: an annularly-cylindrical mechanical clutch portion main body B. An end surface of the mechanical clutch portion main body B close to the mechanical slave gear 322 is arranged as a first annularly-stepped slope 32311 composed of a plurality of slope-shaped steps with the same structure. A first accommodating groove S2 with a ring-shaped radial cross section is formed in an end surface of the mechanical clutch portion main body B close to the mechanical master gear 321. The bottom wall of the first accommodating groove S2 is arranged as a second annularly-stepped slope 32312 composed of a plurality of slope-shaped steps. A height difference exists between the start and the end of each slope-shaped step in each annularly-stepped slope in the axial direction of the mechanical clutch portion 3231; and the starts of the all slope-shaped steps are located in the same plane, and the ends of the all slope-shaped steps are located in the same plane. According to a specific embodiment of the present invention, in the first annularly-stepped slope 32311, the all slope-shaped steps are connected clockwise or counterclockwise; and the connecting direction of the all slope-shaped steps in the second annularly-stepped slope 32312 is opposite to that of the all slope-shaped steps in the first annularly-stepped slope 32311.

At least two second limiting protrusions 32313 are evenly arranged on an end surface of the mechanical clutch portion main body 321 close to the mechanical master gear, and are close to an outer wall side of the mechanical clutch portion main body. Preferably, a through hole 32314 is axially formed in the mechanical clutch portion 3231, and one end of the second elastic member 3232 is engaged in the through hole 32314.

In a specific embodiment of the present invention, the number of the first annularly-stepped slope(s) 32311 and the number of the second annularly-stepped slope(s) 32312 may be the same or different. There are at least two slope-shaped steps in each of the first annularly-stepped slope 32311 and the second annularly-stepped slope 32312. In this example, the number of the slope-shaped steps in the first annularly-stepped slope 32311 is the same as that of the slope-shaped steps in the second annularly-stepped slope 32312, and is four; and a centering angle of each slope-shaped step is 90°.

Preferably, a centering angle of a segmental arc between two adjacent second limiting protrusions 32313 is smaller than or equal to that of each slope-shaped step in the second annularly-stepped slope 32312. In a specific embodiment of the present invention, the number of the second limiting protrusions 32313 is three, and the centering angle of the segmental arc between the two adjacent second limiting protrusions 32313 is equal to that of each slope-shaped step in the second annularly-stepped slope 32312, and is 90°.

The mechanical slave gear 322 includes: a mechanical slave gear connecting portion 3222, and a mechanical slave gear meshing portion 3221 extending from the mechanical slave gear connecting portion 3222. A plurality of meshing teeth is arranged on the outer wall of the mechanical slave gear meshing portion 3221. The number of meshing teeth of the mechanical master gear 321 is greater than that of the meshing teeth of the mechanical slave gear 322. Thus, input power of the driving source member 2 is reduced, and the power consumption and the component cost of the automatic door opening device are reduced.

A second accommodating groove S3 with a ring-shaped radial cross section is formed in an end surface of the mechanical slave gear connecting portion 3222 away from the mechanical slave gear meshing portion 3221. The mechanical slave gear connecting portion 3222 includes: a first supporting rotating shaft 32221 perpendicularly extending outwards from a center of the second accommodating groove S3, and a third annularly-stepped slope 32222 which is formed on the bottom wall of the second accommodating groove S3 and is composed of a plurality of slope-shaped steps. The second elastic member 3232 sleeves the first supporting rotating shaft 32221. In the door body opening process, the first annularly-stepped slope 32311 is meshed with the third annularly-stepped slope 32222 to maintain the mechanical clutch member 323 and the mechanical slave gear 322 in a relatively stationary state.

The mechanical slave gear connecting portion 3222 further includes: a second supporting rotating shaft 32223 extending from the first supporting rotating shaft 32221 toward the direction of the mechanical master gear 321; and the second supporting rotating shaft 32223 and the first rotating shaft 114 cooperate with each other to provide a rotating shaft for the mechanical clutch gear set 32. In the present embodiment, the second supporting rotating shaft 32223 is inserted into the first rotating shaft 114, and details will not be repeated herein.

The mechanical master gear 321 has a ring-shaped diameter cross section; and a plurality of arc-shaped accommodating holes having the same structure is formed in the mechanical master gear 321 at equal intervals, and runs through the two end surfaces of the mechanical master gear 321, so that the mechanical master gear 321 is radially divided into an inner ring stage 3212 and an outer ring stage 3211 connected to each other. A plurality of meshing teeth is arranged on an outer wall of an end of the outer ring stage 3211 away from the mechanical slave gear 322. The second limiting protrusion 32313 is always movably arranged in the corresponding arc-shaped accommodating hole 3213. Moreover, in an initial rotating process of the mechanical master gear 321, the mechanical master gear 321 moves circumferentially relative to the arc-shaped accommodating hole 3213, and meanwhile, moves axially along the arc-shaped accommodating hole 3213. The working process of the mechanical master gear 321 will be described in detail below.

An end surface of the inner ring stage 3212 close to the mechanical clutch member 323 is arranged as a fourth annularly-stepped slope 32121 composed of a plurality of slope-shaped steps. In the initial state, the second annularly-stepped slope 32312 is meshed with the fourth annularly-stepped slope 32121.

A ring-shaped joint portion 3214 extends from an end surface of the inner ring stage 3212 away from the mechanical clutch member 323, and is close to the inner wall surface side of the inner ring stage 3212. Similarly, the joint portion 3214 and the first rotating shaft 114 cooperate with each other to provide a rotating shaft for the mechanical clutch gear set 32. In the present embodiment, the first rotating shaft 114 is inserted into the ring-shaped joint portion 3214, and details will not be repeated herein.

In a specific embodiment of the present invention, the fourth annularly-stepped slope(s) 32121 and the second annularly-stepped slope(s) 32312 have the same number, but opposite connection directions. Thus, in the initial state, the fourth annularly-stepped slope 32121 is meshed with the second annularly-stepped slope 32312 all the time. In this specific example, a centering angle of each slope-shaped step in the fourth annularly-stepped slope 32121 is also 90°.

Preferably, the number of the arc-shaped accommodating holes 3213 is the same as that of the second limiting protrusions 32313. In a specific embodiment of the present invention, the number of the arc-shaped accommodating holes 3213 is three; and a centering angle of each arc-shaped accommodating hole 3213 is equal to the sum of a centering angle of any second limiting protrusion 32313 and a centering angle of any slope-shaped step in the second annularly-stepped slope 32312.

In a specific embodiment of the present invention, in the initial state, the mechanical master gear 321 is meshed with the mechanical clutch member 323; the second annularly-stepped slope 32312 is meshed with the fourth annularly-stepped slope 32121; the second limiting protrusion 32313 is abutted against one side wall of the corresponding arc-shaped accommodating hole 3213; and the mechanical clutch member 323 is separated from the mechanical slave gear 322.

When the door body opening signal is received, the driving source member 2 is powered on to drive the mechanical master gear 321 to rotate. Before the master gear 321 is first rotated to 90°, since the second annularly-stepped slope 32312 and the fourth annularly-stepped slope 32121 each are composed of slope-shaped steps having the axial height difference and are opposite in arrangement direction, in a process that the mechanical master gear 321 is rotating by 90°, the mechanical clutch portion 3231 in the mechanical clutch member 323 is uniformly pushed in the axial direction thereof to translate toward the direction of the mechanical slave gear 322. Thus the first annularly-stepped slope 32311 of the mechanical clutch member 323 and the third annularly-stepped slope 32222 of the mechanical slave gear 322 are gradually meshed with each other. Meanwhile, the second elastic member 3232 applies an acting force toward the direction of the mechanical master gear 321 to the mechanical clutch portion 3231. When the master gear 321 is first rotated to 90°, the second limiting projection 32313 is abutted against the other side wall of the corresponding arc-shaped accommodating hole 3213; and the first annularly-stepped slope 32311 of the mechanical clutch member 323 and the third annularly-stepped slope 32222 of the mechanical slave gear 322 are fully meshed with each other. After the master gear 321 is first rotated to 90°, the mechanical slave gear 322 and the mechanical master gear 321 are in a transmission state through the mechanical clutch portion 323, so that the pushing rod 41 is driven to move toward the direction of the door body to open the door body, and an acting force toward the distal end of the door body is applied to the first elastic member 42. After the door body is opened, the driving source member 2 is powered off, and the first elastic member 42 applies a tensioning force to the pushing rod 41, so that the pushing rod 41 is driven to move toward the inside of the base 1, and the mechanical slave gear 322 is driven to rotate backward. When the mechanical slave gear 322 rotates backward, the mechanical clutch member 323 is driven to rotate backward at a constant speed. Under the tensioning force of the second elastic member 3232, the second annularly-stepped slope 32312 is gradually meshed with the fourth annularly-stepped slope 32121; and when the mechanical slave gear 322 is first rotated to 90°, the mechanical clutch gear set 32 is recovered to the initial connection state.

In the automatic door opening device provided by the second embodiment of the present invention, the pushing member can be automatically recovered to the initial state through the first elastic member arranged in the pushing member after the pushing member drives the door body to be opened. Further, through the mechanical clutch gear set, noise indirectly generated to the driving source member in the resetting process of the pushing member is avoided. Meanwhile, in the automatic door opening device adopting the above structure, after the door body is opened, there is no need to electrically drive the pushing member to be reset, so that the power consumption and the component cost of the automatic door opening device are reduced.

Figure 11:
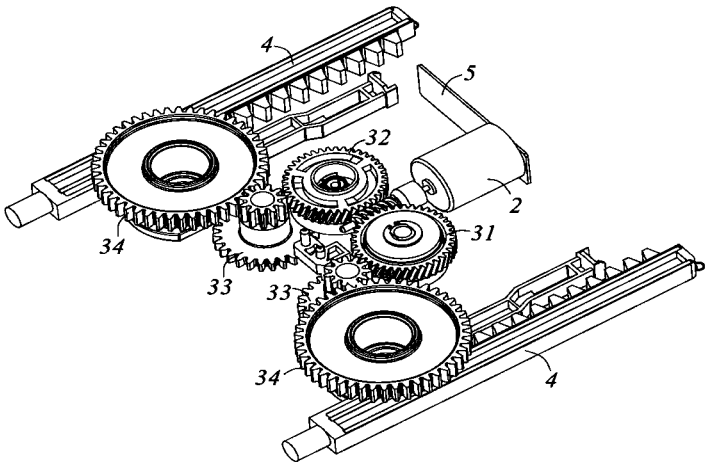
FIG. 11 is a schematically structural view of an automatic door opening device without a base according to a third embodiment of the present invention.

As shown in FIG. 11, an automatic door opening device according to a third embodiment of the present invention is configured to simultaneously open two door bodies. Therefore, there are two above-described pushing members 4 with respect to the automatic door opening device according to the first embodiment or the second embodiment.

Referring to the first embodiment or the second embodiment, two openings 111 allowing the two pushing members 4 to extend out are formed in the front wall of the base 1, and are close to the two side walls, respectively. Elongated guiding grooves extending longitudinally protrude from positions of the bottom wall of the base 1 close to the two side walls, respectively. One ends of the two guiding grooves correspond to the two openings, respectively. An electric motor fixing groove is formed in a symmetric axis between the two guiding grooves. There are two first rotating shafts, two second rotating shafts and two third rotating shafts which are respectively symmetrically distributed along the symmetric axis between the two guiding grooves.

In this embodiment, the structure of the driving source member is completely the same as that of the driving source member in the first embodiment or the second embodiment, and the difference therebetween only lies in the position. The position of the driving source member in this embodiment can be clearly known based on the description of the base 1, and thus, will not be repeated herein.

In this embodiment, the structure of the pushing member is also completely the same as that of the pushing member 4 in the first embodiment or the second embodiment, and the difference therebetween only lies in the position and the number. It can be clearly known that in this embodiment, the two pushing members are symmetrically close to the two opposite side walls of the base 1 respectively based on the description of the base 1; the two electric clutch gear sets are symmetrically arranged between the two pushing members 4; and the driving source member 2 is arranged between the two electric clutch gear sets. Details will not be repeated herein.

In this embodiment, the transmission body 6 includes: two clutch gear sets meshed with the two pushing members, respectively. Each clutch gear set includes: two portions, namely a first portion and a second portion which are selectively connected to each other. The first portion is connected to the driving source member, and the second portion is connected to the corresponding pushing member. When the door body opening signal is received, the first portion and the second portion of at least one of the two clutch gear sets are connected to be in a transmission state; the driving source member drives the clutch gear set currently in the transmission state to move, so that the pushing member corresponding to this clutch gear set is driven to move toward the outside of the base 1 to open the door body; and an acting force toward the distal end of the door body is applied to the first elastic member. After the door body is opened, the first portion and the second portion of the clutch gear set that currently drives the door body to be opened are disengaged from the transmission state; the first portion of this clutch gear set maintains a stationary state; and the first elastic member applies a tensioning force to the pushing rod, so that the pushing rod is driven to move toward the inside of the base 1, and the second portion of this clutch gear set is driven to move.

According to a specific example of the present invention, in the automatic door opening device in the third embodiment, one of the two clutch gear sets is the electric clutch gear set 31 in the first embodiment, and the other clutch gear set is the mechanical clutch gear set 32 in the second embodiment.

In practical applications, the arrangement directions of the meshing teeth of the two clutch gear sets are opposite, so that after the driving source member 2 is powered on, the two clutch gear sets are driven simultaneously, thereby simultaneously pushing the two pushing members 4 to simultaneously open the two door bodies. Details will not be repeated herein.

Of course, in other embodiments of the present invention, if the arrangement directions of the meshing teeth of the two clutch gear sets are the same, the two door bodies can be opened sequentially through forward rotation control and backward rotation control by a driving source member. Or, based on the layout of the meshing teeth of the electric master gear, the two door bodies can be controlled to be opened successively through a driving source member. Details will not be repeated herein.

Figure 12:
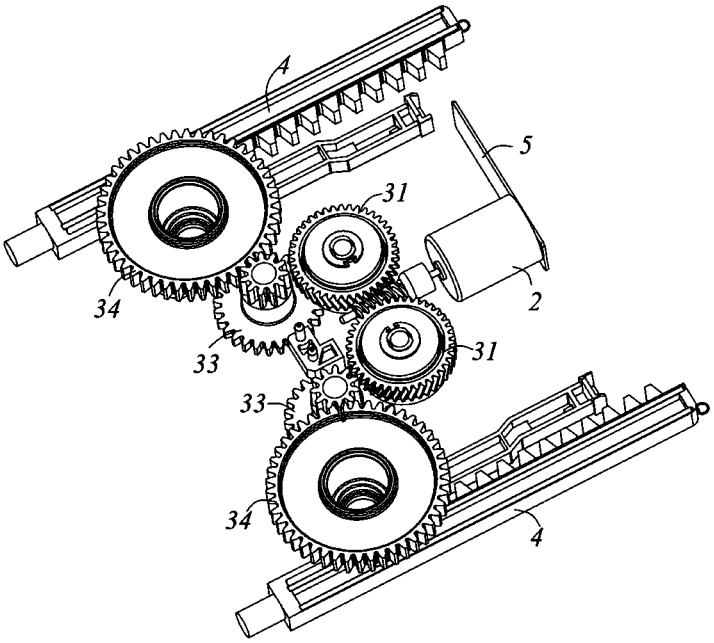
FIG. 12 is a schematically structural view of an automatic door opening device without a base according to a fourth embodiment of the present invention.

As shown in FIG. 12, an automatic door opening device in a fourth embodiment of the present invention and the automatic door opening device in the third embodiment have the similar structure, and both are configured to simultaneously open two door bodies. The automatic door opening device in the fourth embodiment differs from the automatic door opening device in the third embodiment in that the two clutch gear sets have the same structure, and are the electric clutch gear sets in the first embodiment of the present invention. In practical applications, the arrangement directions of the meshing teeth of the two electric clutch gear sets are opposite, so that after the driving source member 2 is powered on, the two electric clutch gear sets can be driven simultaneously, thereby simultaneously pushing the two pushing members 4 to simultaneously open the two door bodies. Details will not be repeated herein.

Of course, in other embodiments of the present invention, if the arrangement directions of the meshing teeth of the two electric clutch gear sets are the same, the two door bodies can be opened sequentially through forward rotation control and backward rotation control by a driving source member. Or, based on the layout of the meshing teeth of the electric master gear, the two door bodies can be controlled to be opened successively through a driving source member. Details will not be repeated herein.

Figure 13:
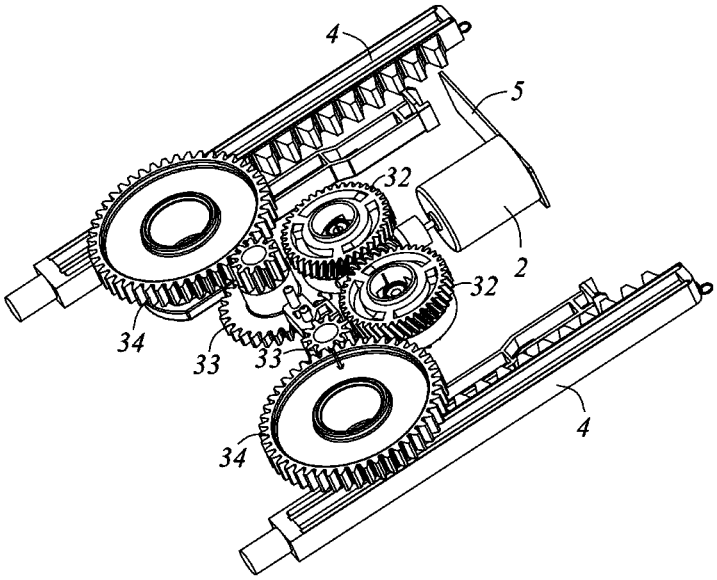
FIG. 13 is a schematically structural view of an automatic door opening device without a base according to a fifth embodiment of the present invention.

As shown in FIG. 13, an automatic door opening device in a fifth embodiment of the present invention and the automatic door opening device in the third embodiment have the similar structure, and both are configured to simultaneously open two door bodies. The automatic door opening device in the fifth embodiment differs from the automatic door opening device in the third embodiment in that the two clutch gear sets have the same structure, and are the mechanical clutch gear sets in the second embodiment of the present invention. Similarly, in practical applications, the arrangement directions of the meshing teeth of the two mechanical clutch gear sets are opposite, so that after the driving source member 2 is powered on, the two mechanical clutch gear sets can be driven simultaneously, thereby simultaneously pushing the two pushing members 4 to simultaneously open the two door bodies. Details will not be repeated herein.

Of course, in other embodiments of the present invention, if the arrangement directions of the meshing teeth of the two mechanical clutch gear sets are the same, the two door bodies can be opened sequentially through forward rotation control and backward rotation control by a driving source member. Or, based on the layout of the meshing teeth of the mechanical master gear, the two door bodies can be controlled to be opened successively through a driving source member. Details will not be repeated herein.

The automatic door opening device in the third embodiment, the fourth embodiment or the fifth embodiment of the present invention may correspond to one door body. Details will not be repeated herein.

In the automatic door opening device in the third embodiment, the fourth embodiment or the fifth embodiment of the present invention, the pushing member can be automatically recovered to the initial state through the first elastic member arranged in the pushing member after the pushing member drives the door body to be opened. Further, through the clutch gear sets, noise indirectly generated to the driving source member in the resetting process of the pushing member is avoided. In the automatic door opening device with the above structure, after the door body is opened, there is no need to electrically drive the pushing member to be reset, so that the power consumption and the component cost of the automatic door opening device are reduced. Meanwhile, in the automatic door opening device in the third embodiment, the fourth embodiment or the fifth embodiment of the present invention, the door body can be opened according to changes of the arrangement direction, the positions and the number of the meshing teeth in the clutch gear set, or according to a door body opening order assigned by a user. Moreover, in the specific embodiment of the present invention, in the door body opening process, the two clutch gear sets are driven by the electric motor to rotate simultaneously to open the two door bodies at the same time, so that the power consumption and the component cost of the automatic door opening device are further reduced.

Figure 14:
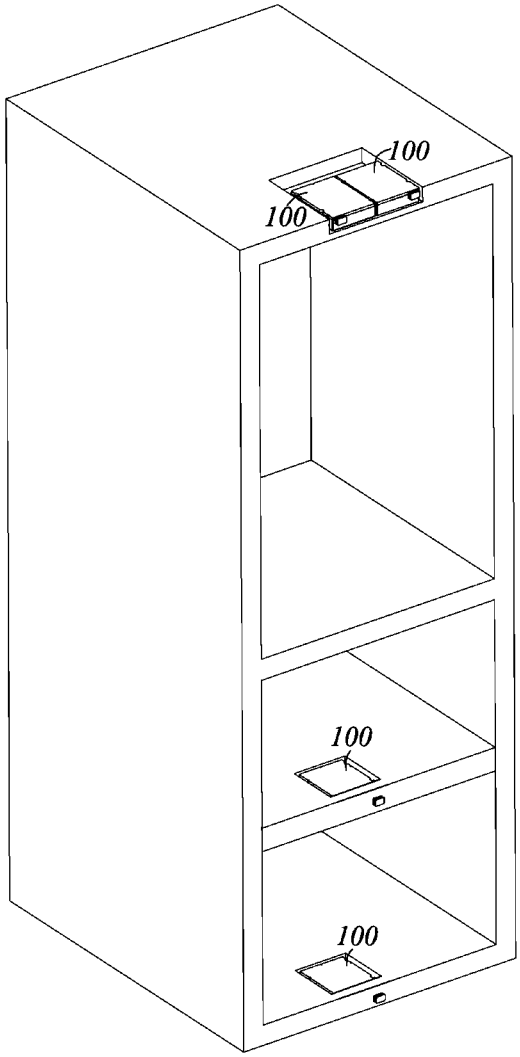
FIG. 14 is a schematically partial structure view of a refrigerator using the automatic opening device according to at least one of the first embodiment and the second embodiment.
Figure 15:
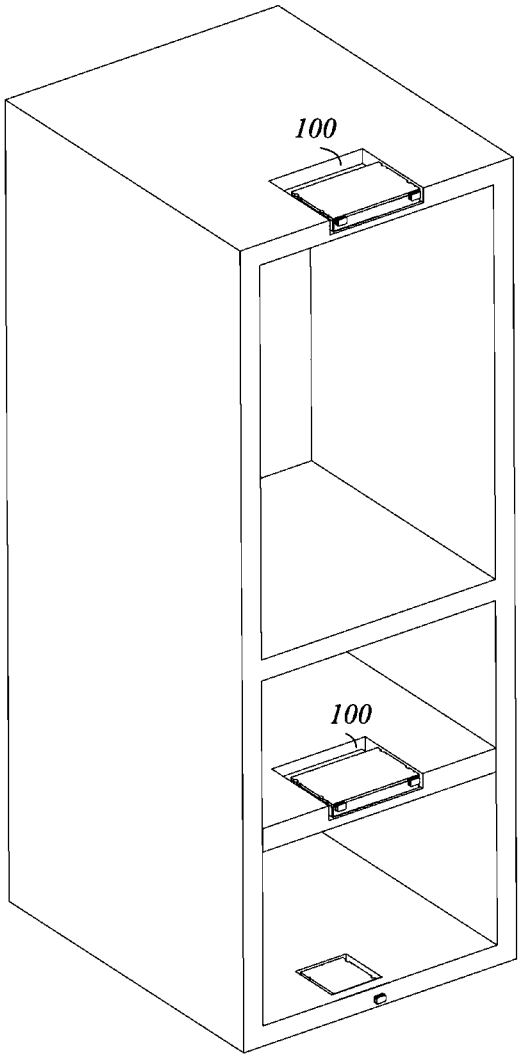
FIG. 15 is a schematically partial structure view of a refrigerator using the automatic opening device according to at least one of the third embodiment, the fourth embodiment and the fifth embodiment.

In addition, as shown in FIGS. 14 and 15, a refrigerator 500 designed in the present invention includes: a refrigerator body 51 having a compartment, a drawer arranged on the refrigerator body 51, a door body for opening or closing the compartment, and the automatic door opening device 100 described in any of the above embodiments. The automatic opening device 100 for opening the door body is arranged at the top of the refrigerator body 51 or the front side of a middle partition. The automatic opening device 100 for opening the drawer may be arranged in the compartment behind the drawer door body, or arranged at the rear side of the drawer; and all of these can achieve the object of the present invention.

It should be understood that although the description is described based on the embodiments, not every embodiment includes only one independent technical solution. This statement of the description is only for clarity. Those skilled in the art should treat the description as a whole, and technical solutions in all of the embodiments may also be properly combined to form other embodiments that will be understood by those skilled in the art.

The above detailed description only aims to specifically illustrate the available embodiments of the present invention, and is not intended to limit the protection scope of the present invention. Equivalent embodiments or modifications thereof made without departing from the spirit of the present invention shall fall within the protection scope of the present invention.

What is claimed is:

1. An automatic door opening device configured to automatically open a door body of a refrigerator, the automatic door opening device comprising: a base, a driving source member fixed in the base, two pushing members which have the same structure and are configured to push the door body to be opened, and a transmission body configured to mesh the driving source member with the two pushing members, wherein:

each of the two pushing members comprises: a pushing rod and a first elastic member connected to the pushing rod and arranged away from the door body;

the transmission body comprises: two mechanical clutch gear sets which are meshed with the two pushing members respectively and have the same structure, wherein the mechanical clutch gear set comprises a mechanical master gear meshed with the driving source member, a mechanical slave gear meshed with one of the two pushing members, and a mechanical clutch member for selectively connecting the mechanical master gear and the mechanical slave gear;

in an initial state, the mechanical master gear is partially engaged with the mechanical clutch member, and is partially meshed with the mechanical clutch member; and the mechanical clutch member is separated from the mechanical slave gear;

in a door body opening process, the mechanical master gear of one of the at least two mechanical clutch gear sets is partially engaged with the mechanical clutch member which is meshed with the mechanical slave gear; the driving source member drives the mechanical master gear to drive the mechanical slave gear to be in a transmission state, so that the pushing rod corresponding to the mechanical slave gear is driven to move toward the outside of the base to open the door body, and an acting force toward a distal end of the door body is applied to the first elastic member;

after the door body is opened, the mechanical clutch gear set that currently drives the door body to be opened is recovered to an initial connection state; the mechanical master gear is in a stationary state; and the first elastic member applies a tensioning force to a corresponding pushing rod, so that the corresponding pushing rod is driven to move toward the inside of the base, and the mechanical slave gear corresponding to the corresponding pushing rod is driven to rotate backward;

the mechanical master gear, the mechanical slave gear and the mechanical clutch in each mechanical gear set are arranged coaxially;

the mechanical clutch member comprises: a mechanical clutch portion and a second elastic member that stretches and shrinks in the axial direction of the mechanical clutch portion;

one end of the second elastic member is detachably connected to the mechanical clutch portion, and the other end of the second elastic member is movably connected to the mechanical master gear or the base;

in the initial state, the mechanical master gear is partially engaged with the mechanical clutch member, and is partially meshed with the mechanical clutch member; and the mechanical clutch member is separated from the mechanical slave gear;

in the door body opening process, the mechanical master gear is partially engaged with the mechanical clutch member which is meshed with the mechanical slave gear; and the second elastic member applies an acting force toward the mechanical master gear to the mechanical clutch portion; and after the door body is opened, the second elastic member applies a tensioning force to the mechanical clutch portion to drive the mechanical clutch portion to move toward the direction of the mechanical master gear, so that the initial state is recovered.

2. The automatic door opening device of claim 1, wherein the two pushing members are symmetrically close to two opposite side walls of the base, respectively; the two mechanical clutch gear sets are symmetrically arranged between the two pushing members; the driving source member is arranged between the two mechanical clutch gear sets; and meshing teeth on the two mechanical clutch gear sets are arranged in opposite directions.

3. The automatic door opening device of claim 1, wherein a through hole is axially formed in the mechanical clutch portion, and one end of the second elastic member is engaged in the through hole.

4. The automatic door opening device of claim 1, wherein:

the mechanical clutch portion comprises: an annularly-cylindrical mechanical clutch portion main body;

an end surface of the mechanical clutch portion main body close to the mechanical slave gear is arranged as a first annularly-stepped slope composed of a plurality of slope-shaped steps;

a first accommodating groove with a ring-shaped radial cross section is formed in an end surface of the mechanical clutch portion main body close to the mechanical master gear;

the bottom wall of the first accommodating groove is arranged as a second annularly-stepped slope composed of a plurality of slope-shaped steps;

at least two second limiting protrusions are evenly arranged on the end surface of the mechanical clutch portion main body close to the mechanical master gear, and are close to an outer wall side of the mechanical clutch portion main body;

a height difference exists between the start and the end of each slope-shaped step in each annularly-stepped slope in the axial direction of the mechanical clutch portion, the starts of the all slope-shaped steps are located in the same plane, and the ends of the all slope-shaped steps are located in the same plane;

in the first annularly-stepped slope, the all slope-shaped steps are connected clockwise or counterclockwise; and in the second annularly-stepped slope, a connecting direction of the all slope-shaped steps is opposite to that of the all slope-shaped steps in the first annularly-stepped slope.

5. The automatic door opening device of claim 4, wherein:

the mechanical slave gear comprises: a mechanical slave gear connecting portion, and a mechanical slave gear meshing portion extending from the mechanical slave gear connecting portion;

a plurality of meshing teeth is arranged on an outer wall of the mechanical slave gear meshing portion;

a second accommodating groove with a ring-shaped radial cross section is formed in an end surface of the mechanical slave gear connecting portion away from the mechanical slave gear meshing portion;

the mechanical slave gear connecting portion further comprises: a first supporting rotating shaft perpendicularly extending outwards from a center of the second accommodating groove, and a third annularly-stepped slope which is formed on the bottom wall of the second accommodating groove and is composed of a plurality of slope-shaped steps;

the second elastic member sleeves the supporting rotating shaft; and in the door body opening process, the first annularly-stepped slope is meshed with the third annularly-stepped slope to maintain the mechanical clutch member and the mechanical slave gear in a relatively stationary state.

6. The automatic door opening device of claim 4, wherein:

the mechanical master gear has a ring-shaped diameter cross section; a plurality of arc-shaped accommodating holes having the same structure is formed in the mechanical master gear at an equal interval, and runs through the two end surfaces of the mechanical master gear, so that the mechanical master gear is radially divided into an inner ring stage and an outer ring stage connected to each other;

a plurality of meshing teeth is arranged on an outer wall of an end of the outer ring stage away from the mechanical slave gear;

the second limiting protrusion is always movably arranged in a corresponding arc-shaped accommodating hole;

an end surface of the inner ring stage close to the mechanical clutch member is arranged as a fourth annularly-stepped slope composed of a plurality of slope-shaped steps; and in the initial state, the second annularly-stepped slope is meshed with the fourth annularly-stepped slope.

7. The automatic door opening device of claim 1, wherein the transmission body further comprises: at least one set of transmission wheels corresponding to each mechanical clutch gear set;

each set of the transmission wheels is simultaneously meshed with a corresponding pushing member and mechanical clutch gear set; and/or each set of the transmission wheels is simultaneously meshed with a corresponding mechanical clutch gear set and the driving source member.

8. A refrigerator, comprising: a refrigerator body having a compartment, a drawer arranged on the refrigerator body, and a door body for opening or closing the compartment, wherein the refrigerator is provided with the automatic door opening device of claim 1 to open the drawer or the door body.

* * * * *